United States Patent [19]

Yoshimura et al.

[11] 4,434,775

[45] Mar. 6, 1984

[54] APPARATUS FOR CONTROLLING PRESSURIZED AIR SUPPLY TO ENGINES

[75] Inventors: Junjiro Yoshimura, Okazaki; Kenji Yamada, Aichi; Haruyuki Obata, Susono, all of Japan

[73] Assignees: Nippondenso Co., Ltd., Kariya; Toyota Jidosha Kabushiki Kaisha, Toyota, both of Japan

[21] Appl. No.: 399,956

[22] Filed: Jul. 19, 1982

[30] Foreign Application Priority Data

| | | | |
|---|---|---|---|
| Jul. 21, 1981 | [JP] | Japan | 56-112952 |
| Aug. 5, 1981 | [JP] | Japan | 56-116510 |
| Sep. 14, 1981 | [JP] | Japan | 56-136601 |
| Sep. 16, 1981 | [JP] | Japan | 56-137449 |
| Sep. 16, 1981 | [JP] | Japan | 56-137450 |

[51] Int. Cl.[3] ..... F02D 23/00

[52] U.S. Cl. ..... 123/564; 60/611

[58] Field of Search ..... 60/600, 601, 611; 123/559, 564

[56] References Cited

U.S. PATENT DOCUMENTS

| | | | |
|---|---|---|---|
| 2,311,936 | 2/1943 | Elfes et al. | 123/564 |
| 2,356,379 | 8/1944 | Caris et al. | 123/564 |
| 2,559,859 | 7/1951 | Elliot et al. | 123/559 X |
| 2,578,028 | 12/1951 | Udale | 60/601 |
| 4,222,240 | 9/1980 | Castellano | 60/611 |
| 4,350,135 | 9/1982 | Casey et al. | 123/564 |

FOREIGN PATENT DOCUMENTS

| | | | |
|---|---|---|---|
| 2435707 | 2/1976 | Fed. Rep. of Germany | 60/611 |
| 1437187 | 5/1976 | United Kingdom | 60/611 |

*Primary Examiner*—Michael Koczo

*Attorney, Agent, or Firm*—Cushman, Darby & Cushman

[57] ABSTRACT

An apparatus for controlling pressurized air supply to an engine has an intake passage connected to the engine at the downstream end thereof. A throttle valve is disposed at a downstream side of the intake passage. A supercharger control valve is disposed at an upstream side of the throttle valve in the intake passage. A supercharger passage containing a supercharger is connected to the intake passage at both upstream and downstream sides of the supercharger control valve. An actuator has an actuating body for dividing the actuator into a first and second pressure chambers. The actuating body is operatively connected to the supercharger control valve to close and open it according to the movement of the actuating body. A compression coil spring is provided in the first pressure chamber for normally pressing the actuating body to open the supercharger control valve. A change-over valve comprises a first pressure-receiving chamber communicating with the first pressure chamber and a second pressure-receiving chamber communicating with the second pressure chamber and the portion of the intake passage between the throttle valve and the supercharger control valve, and a valve body for selectively effecting the communication between the first and second pressure-receiving chambers and between the second pressure-receiving chamber and the portion of the intake passage between the throttle valve and the supercharger valve. A pressure introducing passage communicates with the first pressure chamber at its one end and to the downstream of the throttle valve in the intake passage at its other end.

18 Claims, 12 Drawing Figures

APPARATUS FOR CONTROLLING PRESSURIZED AIR SUPPLY TO ENGINES

BACKGROUND OF THE INVENTION

The present invention relates to an apparatus for controlling the pressurized air supply to an engine.

It is known that pressurized air is supplied to the intake passage of an engine in order to increase the power of the engine and to decrease fuel consumption. Thus, vehicle engines having superchargers to which this fact is applied have been widely used.

However, the operating conditions of the engine are continuously changing, and superchanging the engine is not necessarily preferred in all operating conditions. For example, when the engine is driven with a low load at a low speed or is idled, supercharging results in loss of power. Further, if the engine is driven with a high load at a low speed, supercharging results in knocking due to incomplete combustion.

In order to eliminate the drawbacks described above, a supercharger control valve is conventionally disposed at the upstream side of a throttle valve in the intake passage. Further, a supercharging passage is provided which by-passes the supercharging control valve, and an air pump acting as the supercharger is disposed in the supercharging passage. The supercharger control valve interlocks with the throttle valve through a link mechanism such that the supercharger control valve is opened when the throttle valve is closed, allowing supercharged air to escape to the upstream side of the intake passage.

However, the supercharged air need not always be supplied to the engine not only when the throttle valve is closed but also when the engine speed, the negative pressure of the intake manifold, engine temperature, or the like is low. Therefore, the conventional controlling means of a supercharger control valve which is interlocked with a throttle valve by way of a link mechanism cannot make highly precise supercharging control according to engine operating conditions.

Further, in the conventional controlling means, the throttle valve and the supercharger control valve cannot be controlled independently. Therefore, when the supercharger control valve remains closed due to accidental engagement of the link or valve mechanism thereby to hold the throttle valve in an open position, supercharging continues, and the engine speed increases uncontrollably.

Further, since the engine is driven with a low load at a low speed when the throttle valve is closed, another control apparatus is proposed. According to this apparatus, the opening of the throttle valve is detected. When the opening of the throttle valve is less than a predetermined value, a pressure difference between the upstream and downstream sides of the throttle valve in the intake passage moves the displaceable element of an actuator, such as a diaphragm whereby the supercharger control valve connected to the diaphragm is fully opened.

However, in the control apparatus using the actuator of this type, if the degree of the opening of the supercharger control valve is great, the stroke of the diaphragm must be large. As a result, a large actuator is required, durability of the diaphragm is degraded, and responsiveness of the diaphragm to the pressure difference is also lowered.

SUMMARY OF THE INVENTION

It is, therefore, an object of the present invention to provide an apparatus for controlling air supply which automatically supercharges an engine with high precision only when the engine requires supercharging.

It is another object of the present invention to provide an apparatus for controlling air supply which immediately opens a supercharger control valve to decrease a pressure in an intake passage when the pressure in the intake passage is higher than a predetermined value.

It is still another object of the present invention to provide an apparatus for controlling air supply which supercharges the engine only after a throttle valve is opened to more than a predetermined degree.

In order to achieve the above objects of the present invention, there is provided an apparatus for controlling pressurized air supply to an engine, comprising: an intake passage connected to the engine at a downstream end thereof; a throttle valve disposed at a downstream side of said intake passage; a supercharger control valve disposed at an upstream side of said throttle valve in said intake passage; a supercharging passage connected to said intake passage at both upstream and downstream sides of said supercharger control valve; a supercharger disposed in said supercharging passage; an actuator which is divided into first and second pressure chambers by an actuating body operatively connected to said supercharger control valve to close said supercharger control valve when said actuating body is moved in a first direction to decrease the volume of said first pressure chamber and to open said supercharger control valve when said actuating body is moved in a second direction to increase the volume of said first pressure chamber, and which has urging means for urging said actuating body in said second direction, said first pressure chamber being connected to a pressure introducing passage and at the downstream of said throttle valve in said intake passage; and a change-over valve which has a first pressure-receiving chamber communicating with said first pressure chamber, a second pressure-receiving chamber communicating with said second pressure chamber and a portion of said intake passage between said throttle valve and said supercharger control valve, and a valve body selectively positioned between a first position where said valve body allows said first pressure-receiving chamber to communicate with said second pressure-receiving chamber and also blocks said second pressure-receiving chamber from said intake passage and a second position where said valve body blocks said first pressure-receiving chamber from said second pressure-receiving chamber and allows said second pressure-receiving chamber to communicate with said intake passage.

BRIEF DESCRIPTION OF THE DRAWINGS

This invention can be fully understood from the following detailed description with reference to the accompanying drawings in which.

DETAILED DESCRIPTION OF THE PREFERRED EMBODIMENTS

Figure 1:
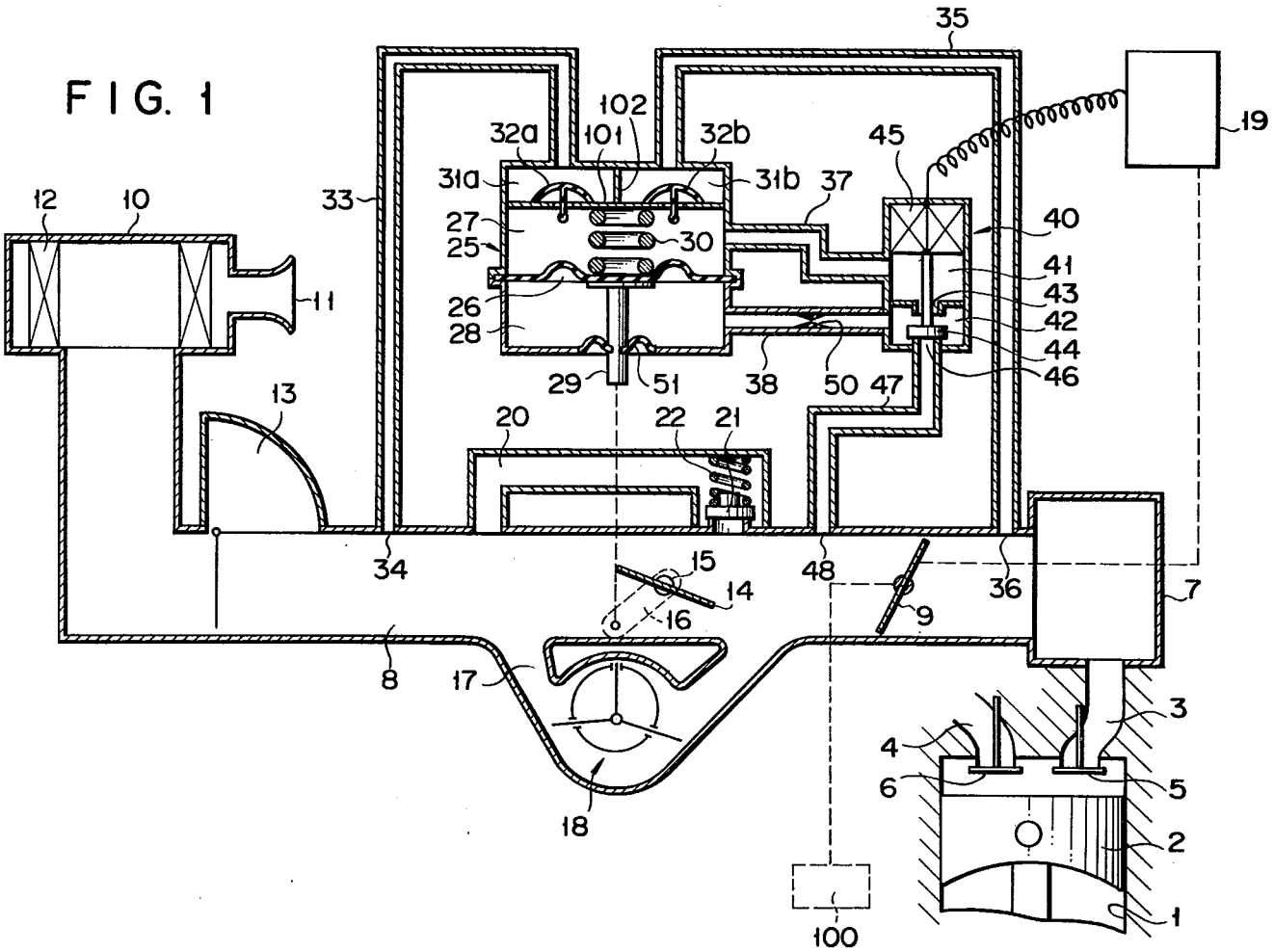
FIG. 1 is a longitudinal sectional view of a control apparatus according to a first embodiment of the present invention, showing a non-supercharging state.

Embodiments and their modifications of the present invention will be described hereinafter, the same reference numerals denoting the same or similar parts throughout the embodiments and the modifications. If description of such parts omitted, the description designated by the same reference numerals of the previous embodiments is applied.

Figure 2:
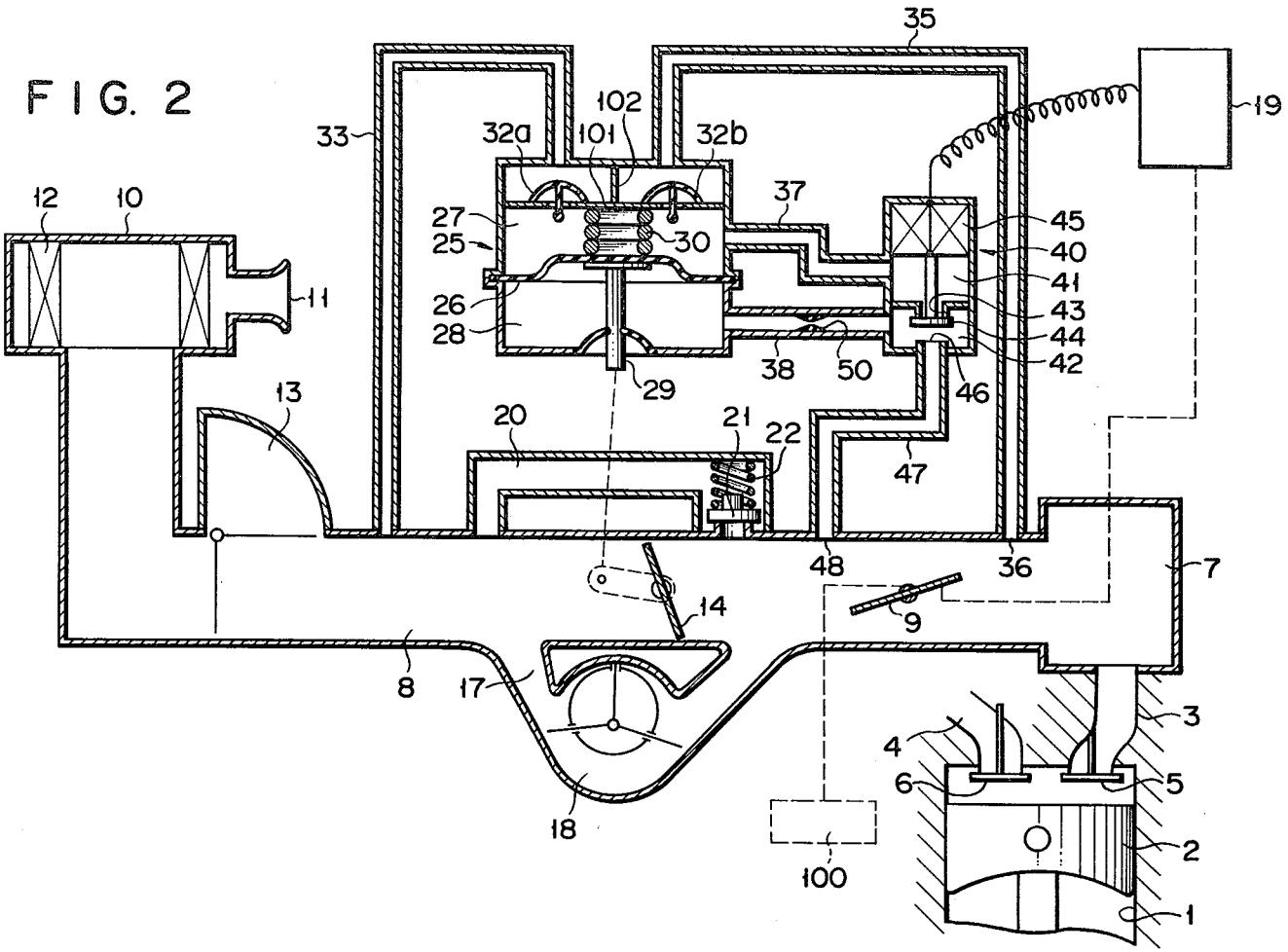
FIG. 2 is a longitudinal sectional view of the control device according to the first embodiment shown in FIG. 1, showing a supercharging state.

FIGS. 1 and 2 show a control apparatus according to a first embodiment. An engine has a cylinder 1, a piston 2 reciprocally inserted therein, and an intake port 3 and an exhaust port 4 which are formed in the piston end of the cylinder 1. The intake port 3 and the exhaust port 4 are respectively opened or closed by an intake valve 5 and an exhaust valve 6. The intake port 3 communicates with a surge tank 7 which in turn communicates with an intake passage 8. A throttle valve 9 is disposed in the downstream side of the intake passage 8, and is opened or closed by a throttle valve operator 100 such as an accelerator pedal. The upstream end of the intake passage 8 communicates with an opening 11 to the atmosphere through an air cleaner 10 which has a cleaner element 12. An air flowmeter 13 is arranged in the upstream side of the intake passage 8.

A supercharger control valve 14 is disposed between the air flowmeter 13 and the throttle valve 9 in the intake passage 8. The supercharger control valve 14 is coupled to a control lever 16 through a valve shaft 15, and pivots with the control lever 16 to open or close the intake passage 8. The operation of the control lever 16 will be described later. A supercharging passage 17 for by-passing the supercharger control valve 14 communicates with the intake passage 8, the upstream end of the supercharging passage 17 communicating with that portion of the intake passage 8 between the air flowmeter 13 and the supercharger control valve 14, and the downstream end thereof communicating with that portion of the intake passage 8 between the supercharger control valve 14 and the throttle valve 9.

An air pump 18 acting as the supercharger is disposed in the supercharging passage 17. The air pump 18 is driven by a crankshaft (not shown) of the engine. In this case, the air pump 18 and the crankshaft are connected by power transmission means such as an endless belt. Further, power is cut off from or supplied to the air pump 18 by an electromagnetic clutch. The electromagnetic clutch is operated by a command signal from an electronic control device 19 such as a microcomputer. The electronic control device 19 detects engine conditions such as the engine speed, the degree of the opening of the throttle valve 9, the negative pressure of the surge tank 7, the engine temperature and the like which require the control of the air pump 18. The electronic control device 19 then supplies an ON command signal to the electromagnetic clutch in accordance with the preset conditions. A relief passage 20 is formed communicating with the intake passage 8 to by-pass the supercharger control valve 14, the upstream end of the relief passage 20 opening to that portion of the intake passage 8 between the air flowmeter 13 and the supercharger control valve 14, and the downstream end thereof communicating with that portion of the intake passage 8 between the supercharger control valve 14 and the throttle valve 9. A relief valve 21 is disposed in the relief passage 20 to allow the escape of pressurized air from the downstream side to the upstream side. The relief valve 21 is urged by a compression coil spring 22 to close the relief passage 20.

Generally shown at 25 is an actuator which has a diaphragm 26 as an actuating body. The diaphragm 26 partitions the actuator 25 into an upper pressure chamber 27 and a lower pressure chamber 28. The diaphragm 26 is coupled to the upper end of an actuating rod 29. The actuating rod 29 extends to the lower end face of the actuator 25, and its lower end is connected to the control lever 16 of the supercharger control valve 14. The actuating rod 29 is sealed by a seal member 51 which is disposed on the lower end face of the actuator 25. When the diaphragm 26 flexes upward, as shown in FIG. 2, the control lever 16 is pivoted clockwise through the actuating rod 29, whereby the supercharger control valve 14 closes the intake passage 8. A compression coil spring 30 is disposed in the upper pressure chamber 27 to normally urge the diaphragm 26 downward. Pressure introducing chambers 31*a* and 31*b* which are partitioned by a partition 102 are formed above the upper pressure chamber 27. The pressure introducing chambers 31*a* and 31*b* are normally separated from the upper pressure chamber 27 by check valves 32*a* and 32*b* which abut against a partition plate 101 between the pressure introducing chambers 31*a* and 31*b* and the upper pressure chamber 27. The pressure introducing chamber 31*a* communicates with a pressure escaping port 34 through a pressure escaping passage 33. The pressure escaping port 34 is open to that portion of the intake passage 8 between the air flowmeter 13 and the supercharger control valve 14. The pressure introducing chamber 31*b* communicates with a first pressure-detecting port 36 through a first pressure-introducing passage 35. The first pressure-detecting port 36 is open to a portion at the downstream side of the throttle valve 9 in the intake passage 8.

A second pressure-introducing passage 37 and a third pressure-introducing passage 38 respectively communicate with the upper and lower pressure chambers 27 and 28 of the actuator 25, and also communicate with a change-over valve 40. The change-over valve 40 has an upper pressure-receiving chamber 41 and a lower pressure-receiving chamber 42. The upper pressure-receiving chamber 41 communicates with the upper pressure chamber 27 of the actuator 25 through the second pressure-introducing passage 37, while the lower pressure-receiving chamber 42 communicates with the lower pressure chamber 28 of the actuator 25 through the third pressure-introducing passage 38. The upper and lower pressure-receiving chambers 41 and 42 of the change-over valve 40 communicates with each other through a valve bore 43. The valve bore 43 is opened or closed by a valve body 44 which extends therethrough. The valve body 44 reciprocates by means of a solenoid coil 45 disposed thereabove. An inlet port 46 is open to the lower pressure-receiving chamber 42 and communicates with a second pressure-detecting port 48 through a fourth pressure-introducing passage 47. The second pressure-detecting port 48 is open to that portion of the intake passage 8 between the throttle valve 9 and the supercharger control valve 14. The valve body 44 reciprocates by the solenoid coil 45 to selectively open the valve bore 43 and the inlet port 46. The selective movement is performed in accordance with a command from the electric control device 19. The electronic control device 19 supplies a command to operate the solenoid coil 45 on the basis of preset conditions corresponding to operating conditions such as the engine speed, the opening of the throttle valve 9, the negative pressure of the surge tank 7, the engine temperature or the like, in the same manner as in the control of the air pump 18. In this case, the actuating timing of the solenoid coil 45 may be the same as that of the air pump 18, or it may be delayed from that of the air pump 18.

An orifice 50 is disposed in the third pressure-introducing passage 38 to delay pressure transmission.

In operation, if the engine is driven with a low load at a low speed or if the engine is idled, the engine operating conditions do not reach the preset conditions which is memorized in the electronic control device 19. In this case, the electromagnetic clutch of the air pump 19 is released, whereby the air pump 18 is not driven. Further, since the ON command signal is not supplied to the solenoid coil 45, the valve body 44 of the change-over valve 40 opens the valve bore 43 and closes the introducing port 46, as shown in FIG. 1. For this reason, the second and third pressure-introducing passages 37 and 38 communicate with each other through the valve bore 43. In consequence, the upper and lower pressure chambers 27 and 28 of the actuator 25 communicate with each other. In the intake passage 8, since the throttle valve 9 is almost closed, a negative pressure is established in the downstream side of the throttle valve 9, whereby the negative pressure is introduced into the pressure introducing chamber 31*b* through the first pressure-detecting port 36 and the first pressure-introducing passage 35. As a result, the check valve 32*b* is opened to keep the pressure of the upper pressure chamber 27 negative. Since the upper and lower pressure chambers 27 and 28 of the actuator 25 communicate with each other through the valve bore 43, the negative pressure of the upper pressure chamber 27 is equal to that of the lower pressure chamber 28. The diaphragm 26 is urged downward by the urging force of the compression coil spring 30, and the actuating rod 29 is moved downward, so that the supercharger control valve 14 causes the intake passage 8 to open.

As described above, if the actual operating conditions do not reach the preset conditions which is memorized in the electronic control device 19, the air pump 18 is stopped. Therefore, the supercharging passage 17 is, in effect, closed and supercharging is not performed. However, air flows into the downstream side of the intake passage 8, where the throttle valve 9 is disposed, through a space around the supercharger control valve 14. In this operating condition, the engine is driven in the same manner as an engine without a supercharger.

However, when the operating conditions such as the engine speed, the degree of opening of the throttle valve, the negative pressure of the surge tank 7 or the engine temperature reach the preset conditions, the electromagnetic clutch of the air pump 18 is actuated in response to a command from the electronic control device 19, whereby the air pump 18 is driven by the crankshaft. As a result, the air pump 18 supplies pressurized air to that portion of the intake passage 8 between the supercharger control valve 14 and the throttle valve 9.

Simultaneously when or slightly after the air pump 18 is driven in accordance with the command from the electronic control device 19, power is supplied to the solenoid coil 45 of the change-over valve 40. As shown in FIG. 2, the valve body 44 closes the valve bore 43 and opens the inlet port 46. As a result, the upper and lower pressure chambers 27 and 28 of the actuator 25 stop communicating with each other. The upper pressure chamber 27 communicates with the downstream of the throttle valve 9 in the intake passage 8 through the check valve 32*b*, the pressure introducing chamber 31*b*, the first pressure-introducing passage 35 and the first pressure-detecting port 36. The lower pressure chamber 28 communicates with the upstream side of the throttle valve 9 in the intake passage 8 through the third pressure-introducing passage 38, the lower pressure-receiving chamber 42 of the change-over valve 40, the fourth pressure-introducing passage 47 and the second pressure-detecting port 48. In the intake passage 8, although the pressurized air from the air pump 18 is supplied to the upstream side of the throttle valve 9, the pressure in the intake passage 8 is at the atmospheric pressure since the superchager control valve 14 is opened. The atmospheric pressure is applied to the lower pressure chamber 28 through the second pressure-detecting port 48, the fourth pressure-introducing passage 47 and the third pressure-introducing passage 38. Further, when the throttle valve 9 is opened, the negative pressure at the downstream side of the intake passage 8 is lower than that when the throttle valve 9 is closed. However, since the check valve 32*b* is closed, the negative pressure in the low load condition is retained in the upper pressure chamber 27. Therefore, the pressure in the upper pressure chamber 27 is negative, and the pressure in the lower pressure chamber 28 is the atmospheric pressure. The negative pressure causes the diaphragm 26 to flex upward against the urging force of the compression coil spring 30, as shown in FIG. 2. Therefore, the actuating rod 29 is moved upward and the supercharger control valve 14 is pivoted clockwise through the control lever 16 to close the intake passage 8.

In the above condition, since the supercharger control valve 14 is closed, the air from the air pump 18 is pressurized and is supplied from the downstream side of the inlet passage 8 to the cylinder 1 of the engine which is thus supercharged. Therefore, power is increased as compared with an engine without a supercharger and fuel is saved. The pressurized air flows from the intake passage 8 into the lower pressure chamber 28 through the second pressure-detecting port 48, the lower pressure-receiving chamber 42, the third pressure-introducing passage 38, so that the lower pressure chamber 28 is kept at a positive pressure which causes the diaphragm 26 to remain flexed upward.

When the engine is decelerated or the throttle valve 9 is closed, the apparatus returns to the conditions shown in FIG. 1 and supercharging is substantially stopped. As a result, the engine is smoothly decelerated.

The check valve 32*a* of the actuator 25 allows for the escape of positively pressurized air from the upper pressure chamber 27 into the pressure introducing chamber 31*a* when the pressurized air flows from the lower pressure-receiving chamber 42 into the upper press-receiving chamber 27 through the valve bore 43 of the change-over valve 40, whereby the upper pressure chamber 27 may not be kept at the positive pressure and the supercharger control valve 14 is kept closed.

The relief valve 21 is opened when the supercharging pressure is higher than the predetermined value, thus preventing excessive increase of the supercharging pressure.

In the first embodiment, if the operating conditions do not reach preset conditions, the change-over valve is actuated to simultaneously introduce the pressure into the intake passage to both pressure chambers thereby allowing the actuating body to maintain the supercharger control valve in the open position. However, if the operating conditions are the same as or higher than the preset conditions, the pressure difference in the chambers of the actuator raises the actuating body, and the supercharger control valve is closed. Therefore, power loss, incomplete combustion, and an excessive increase in the engine speed are prevented, and desirable and smooth driving is performed in all the operating conditions of the engine. Thus, the inherent function of the supercharger is effectively utilized, resulting in an increase in output power of the engine and a decrease in fuel consumption.

Figure 3:
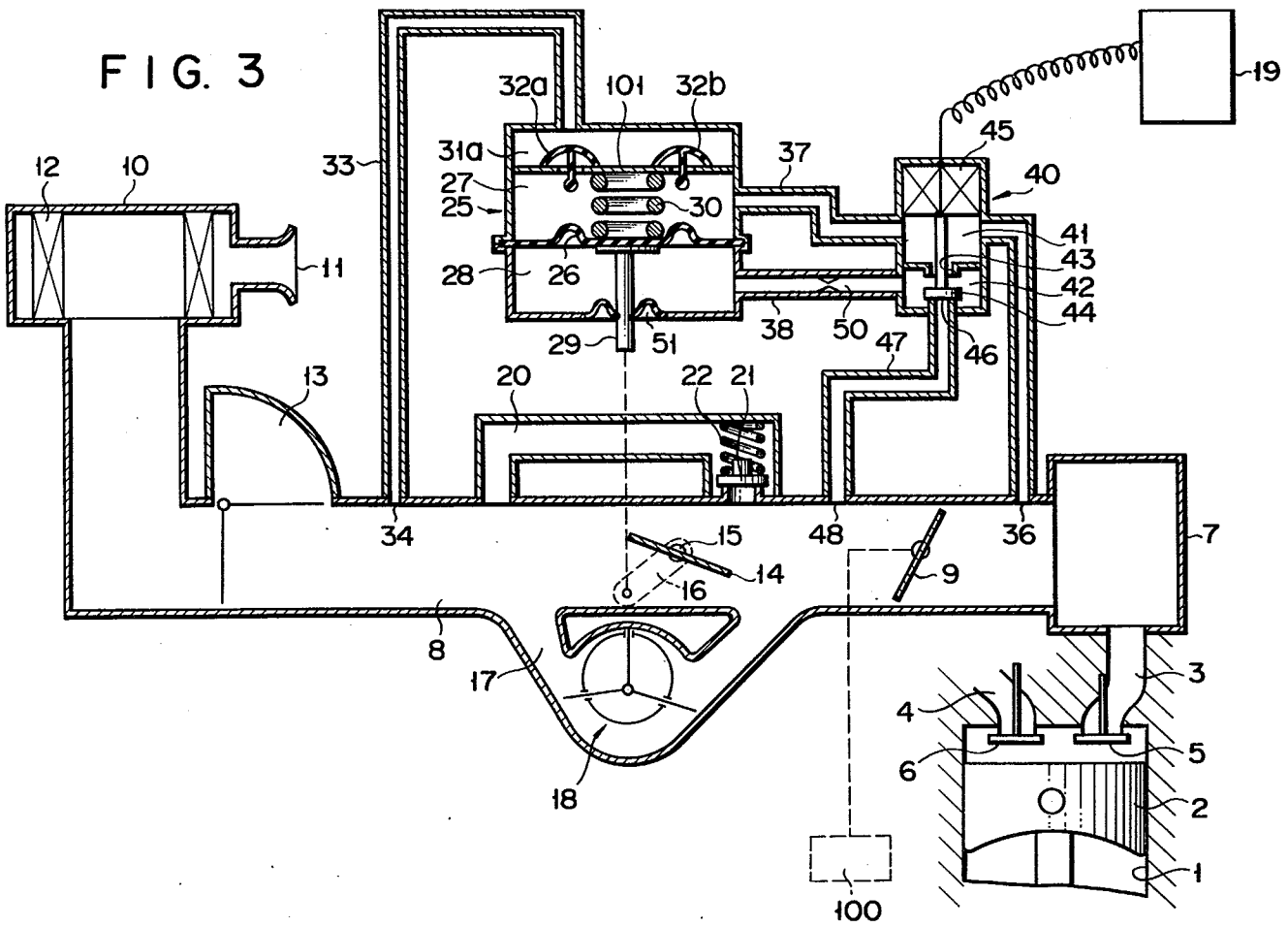
FIGS. 3 and 4 are longitudinal sectional views of modifications of the control apparatus shown in FIGS. 1 and 2.

FIG. 3 is a modification of the apparatus of the first embodiment. The apparatus of this modification is the same as that of the first embodiment except that the first pressure-introducing passage 35 communicates with the upper pressure-receiving chamber of the change-over valve 40 instead of communicating with the pressure introducing chamber 31*b* of the actuator 25.

In this modification, only the pressure introducing chamber 31*a* is disposed above the upper pressure chamber 27 to communicate with the pressure escaping passage 33, and the pressure introducing chamber 31*b* is not provided. The pressure introducing chamber 31*a* has two check valves 32*a* and 32*b*. Further, since a portion downstream of the throttle valve 9 in the intake passage 8 communicates with the upper pressure chamber 27 of the actuator 25 through the upper pressure-receiving chamber 41, a pressure in that portion always is introduced into the upper pressure chamber 27. As a result, the same effect as in the first embodiment is obtained.

Figure 4:
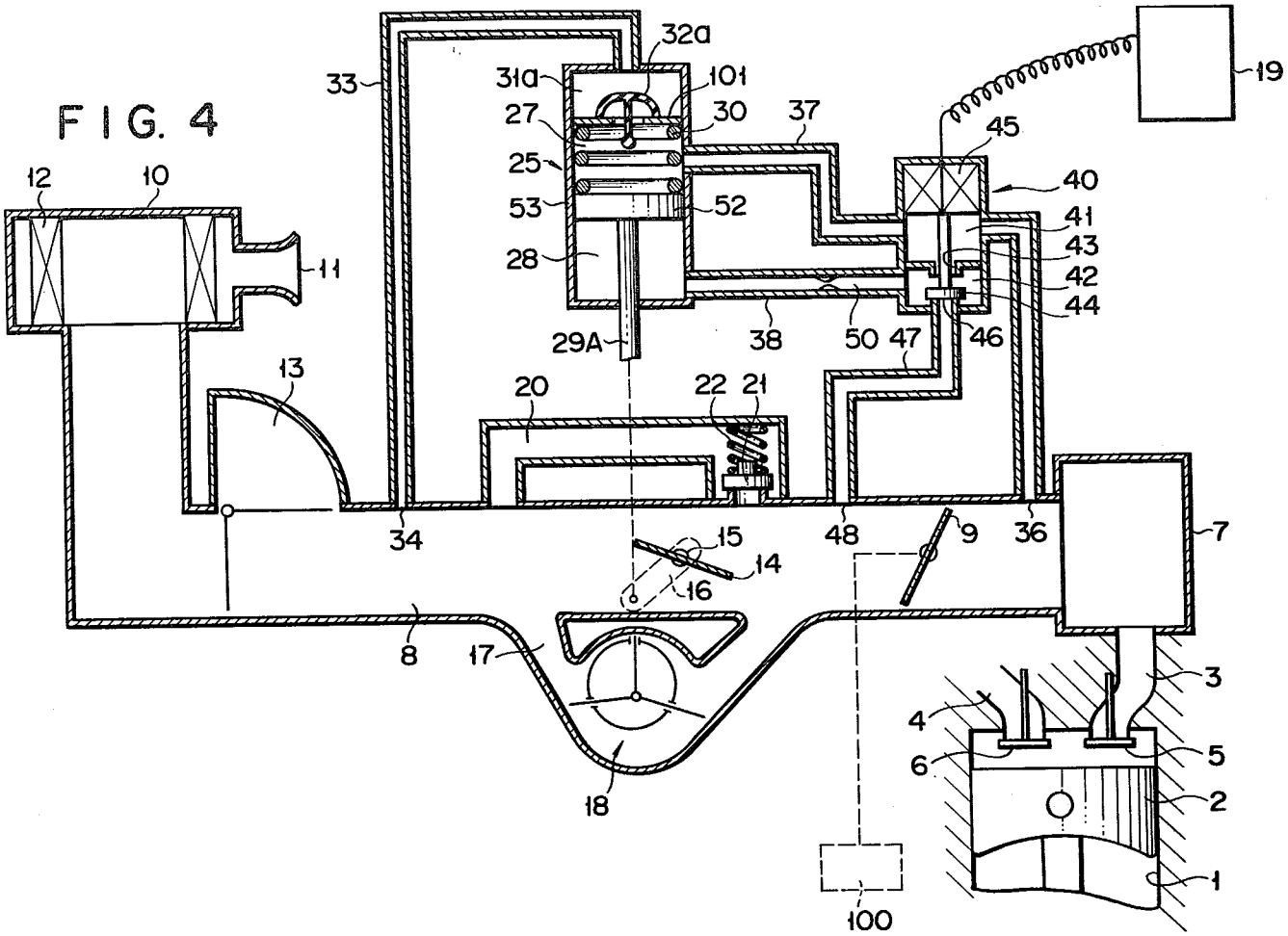

FIG. 4 shows another modification of the first embodiment. A combination of a piston 52 and a cylinder 53 is utilized to form a piston-cylinder assembly. A space on the piston end side is defined as the upper pressure chamber 27, while a space on the piston rod side is defined as the lower pressure chamber 28. A compression coil spring 30 is disposed in the upper pressure chamber 27 to urge the piston 52 downward. The pressure introducing chamber 31*a* is formed above the cylinder end. It contains a check valve 32*a* and communicates with the pressure escaping passage 33. The lower end of a piston rod 54 is connected to the control lever 16 and has the same function as the actuating rod 29 in the first embodiment.

In the modification of FIG. 4, the diaphragm 26 in the modification of FIG. 3 is replaced with the piston 52, the operation thereof being the same as that of the modification of FIG. 3.

Figure 5:
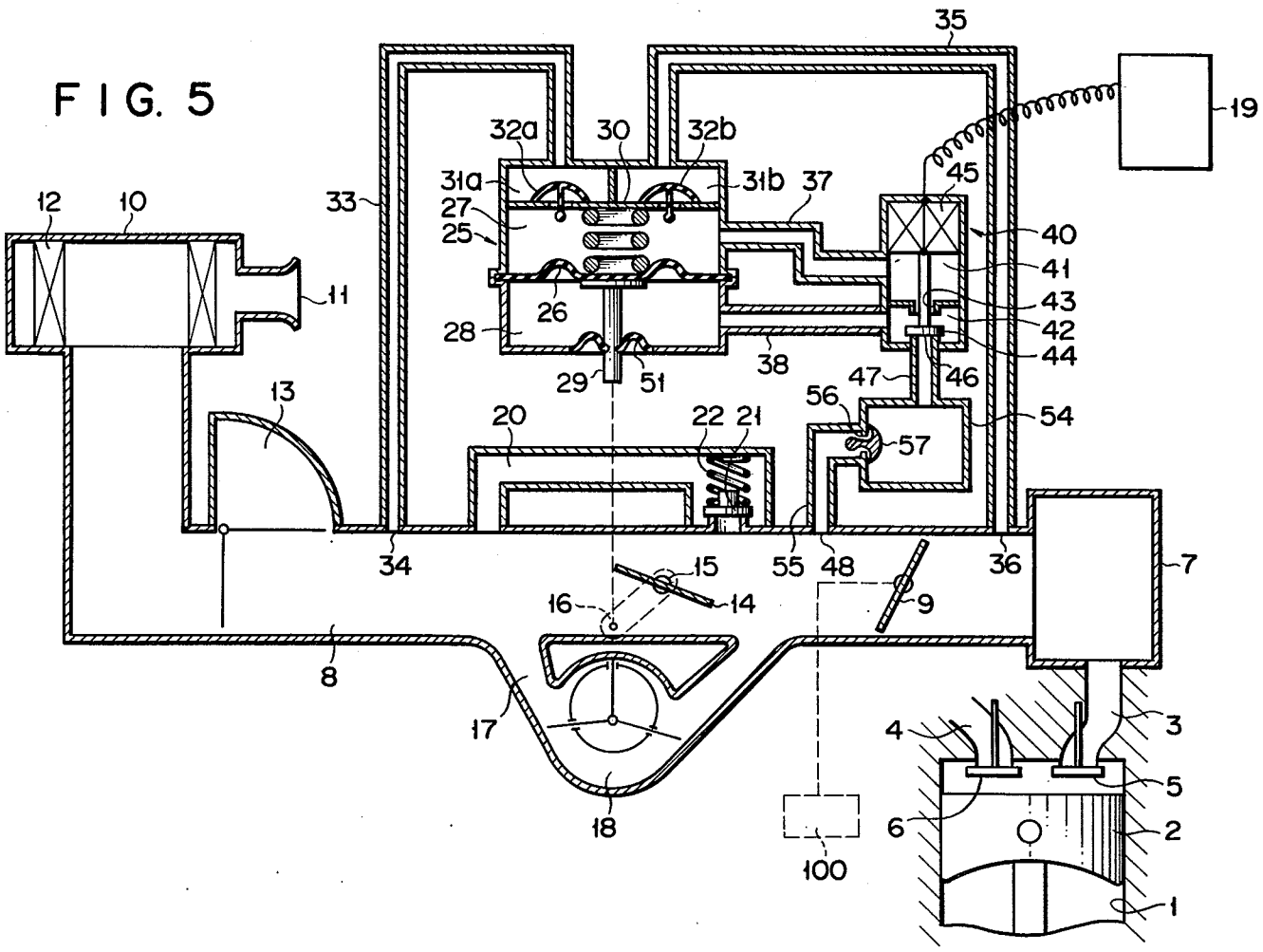
FIGS. 5 and 6 are longitudinal sectional views of a control apparatus according to a second embodiment of the present invention, showing the non-supercharging and supercharging states, respectively.
Figure 6:
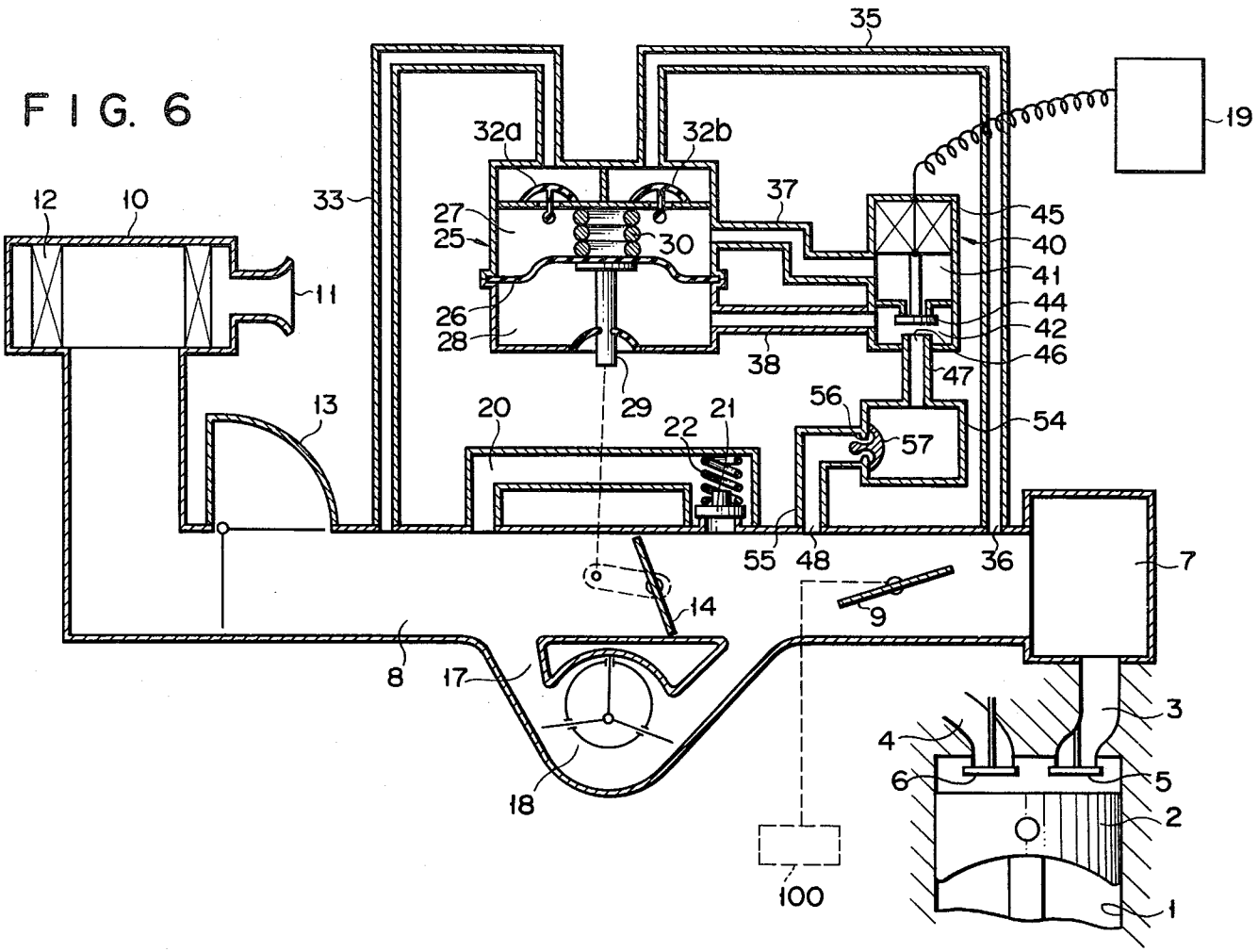

FIGS. 5 and 6 show an apparatus according to a second embodiment of the present invention. The apparatus of the second embodiment is the same as that of the first embodiment except that an accumulator 54 is disposed in the fourth pressure-introducing passage 47. The accumulator 54 communicates with an inlet port 46 formed in the lower wall of a lower pressure-receiving chamber 42 of a change-over valve 40 through a fourth pressure-introducing passage 47. The accumulator 54 also communicates with a second pressure-detecting port 48 formed between a throttle valve 9 and a supercharger control valve 14 in an intake passage 8 through a fifth pressure-introducing passage 55. A check valve 57 is disposed at a connecting port 56 between the fifth pressure-introducing passage 55 and the accumulator 54. The check valve 57 allows for air flow only from the second pressure-detecting port 48 to the change-over valve 40.

When the throttle valve 9 is closed and pressurized air is not supplied to the engine as shown in FIG. 5, the operation thereof is the same as that of the first embodiment.

When the throttle valve 9 is opened to supply the pressurized air to the engine and when a solenoid coil 45 is excited in accordance with a command by an electronic control device 19, a valve body 44 is raised as shown in FIG. 6. As a result, the accumulator 54 communicates with a lower pressure chamber 28 of an actuator 25. The pressurized air causes the check valve 57 to open and continues to flow into the accumulator 54. Subsequently, the pressurized air is supplied to the lower pressure chamber 28 through the lower pressure-receiving chamber 42, whereby the lower pressure chamber 28 is kept at a positive pressure, and a diaphragm 26 is urged upward. An actuating rod 29 is moved upward to close the supercharger control valve 14 and the engine is supercharged. Further, since the pressurized air is accumulated in the accumulator 54, the diaphragm 26 is kept flexed upward due to the positive pressure of the lower pressure chamber 28 even if the negative pressure of the upper pressure chamber 27 leaks to each passage which communicates with the upper pressure chamber 27. As a result, the supercharger valve 14 is kept closed. Meanwhile, when supercharging is performed, the pressurized air is supplied from the intake passage 8 to the accumulator 54 if the pressure in the accumulator 54 decreases. As a result, the accumulator 54 is kept at a high positive pressure.

While the engine is supercharged, the negative pressure in the upper pressure chamber 27 may become the atmospheric pressure due to leakage. In this condition, if the change-over valve 40 is actuated to stop supercharging, the valve body 44 is released from the valve bore 43 as shown in FIG. 6, whereby the upper pressure chamber 27 communicates with the lower pressure chamber 28. The diaphragm 26 is moved downward by the compression coil spring 30 and the supercharger control valve 14 opens the intake passage 8. In this condition, however, when the valve body 44 of the change-over valve 40 is closed to initiate supercharging, the upper pressure chamber 27 does not reach a negative pressure high enough to compress the compression coil spring 30. Since, however, accumulated in the accumulator 54 when the engine is supercharged, the pressurized air is supplied from the accumulator 54 to the lower pressure chamber 28 to move the diaphragm 26 upward due to a positive pressure. As a result, the supercharger control valve 14 is closed and supercharging is properly and smoothly initiated.

The pressure in the pressure introducing chamber 31*b* is kept positive while the engine is supercharged. The pressure introducing chamber 31*b* contains the check valve 32*b*, thus generally preventing the positive pressure from being introduced from the pressure introducing chamber 31*b* into the upper pressure chamber 27. The positive pressure may be applied to the upper pressure chamber 27 through the check valve 32*b* and the valve bore 43 when a foreign material is clogged in the clock valve 32*b* and/or the valve bore 43. In this case, the positive pressure is released from the upper pressure chamber 27 through the check valve 32*a*, the pressure introducing chamber 31*a* and the pressure escaping passage 33, so that no high positive pressure remains in the upper pressure chamber 27. For this reason, the supercharger control valve 14 may not be undesirably operated.

According to the second embodiment of the present invention, the supercharger control valve 14 is highly precisely controlled throughout the operating range of the engine. Thus, the engine is operated at optimum conditions with a maximum output power, and fuel is greatly saved.

Figure 7:
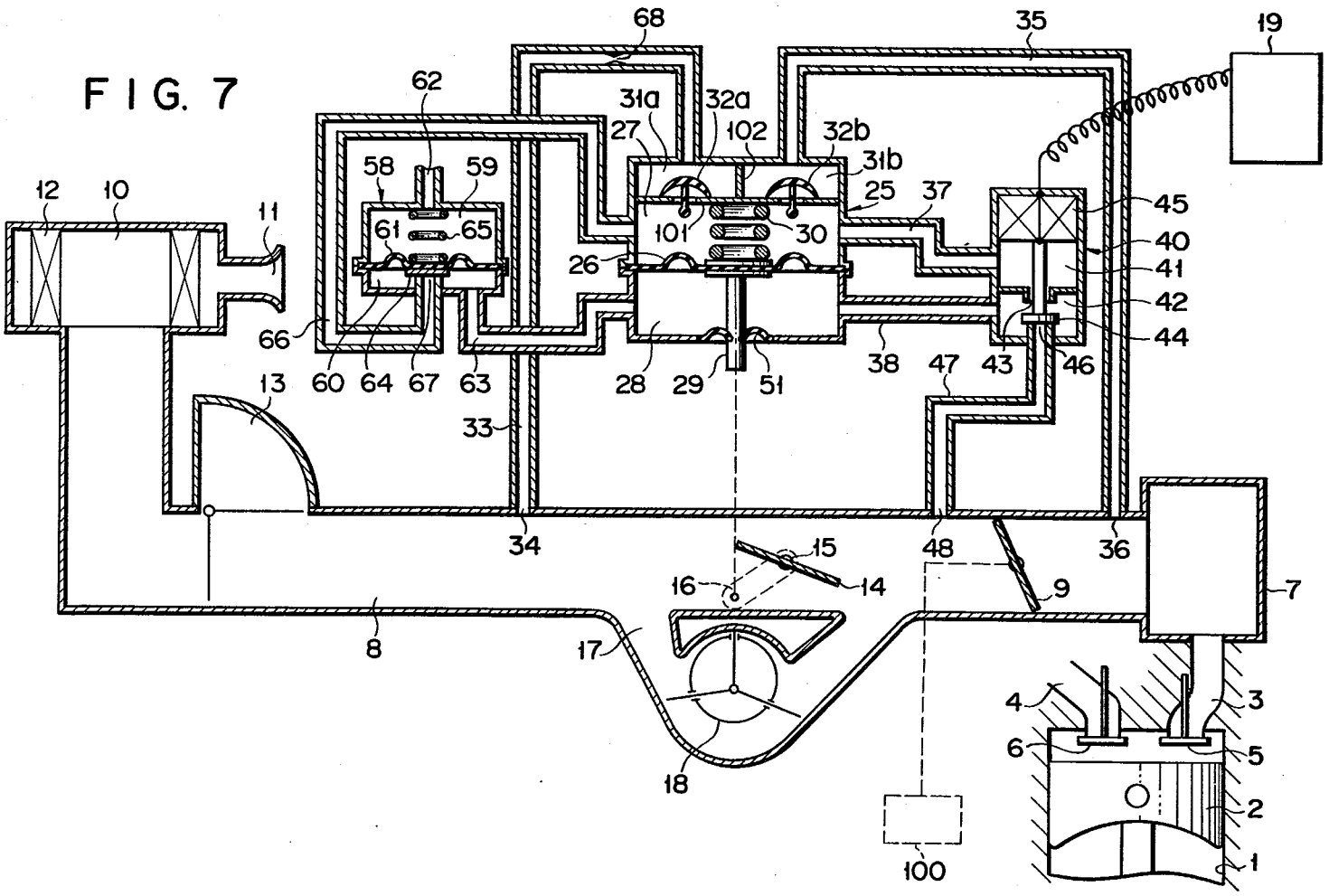
FIGS. 7 and 8 are longitudinal sectional views of a control apparatus according to a third embodiment of the present invention, showing the non-supercharging and supercharging states, respectively.
Figure 8:
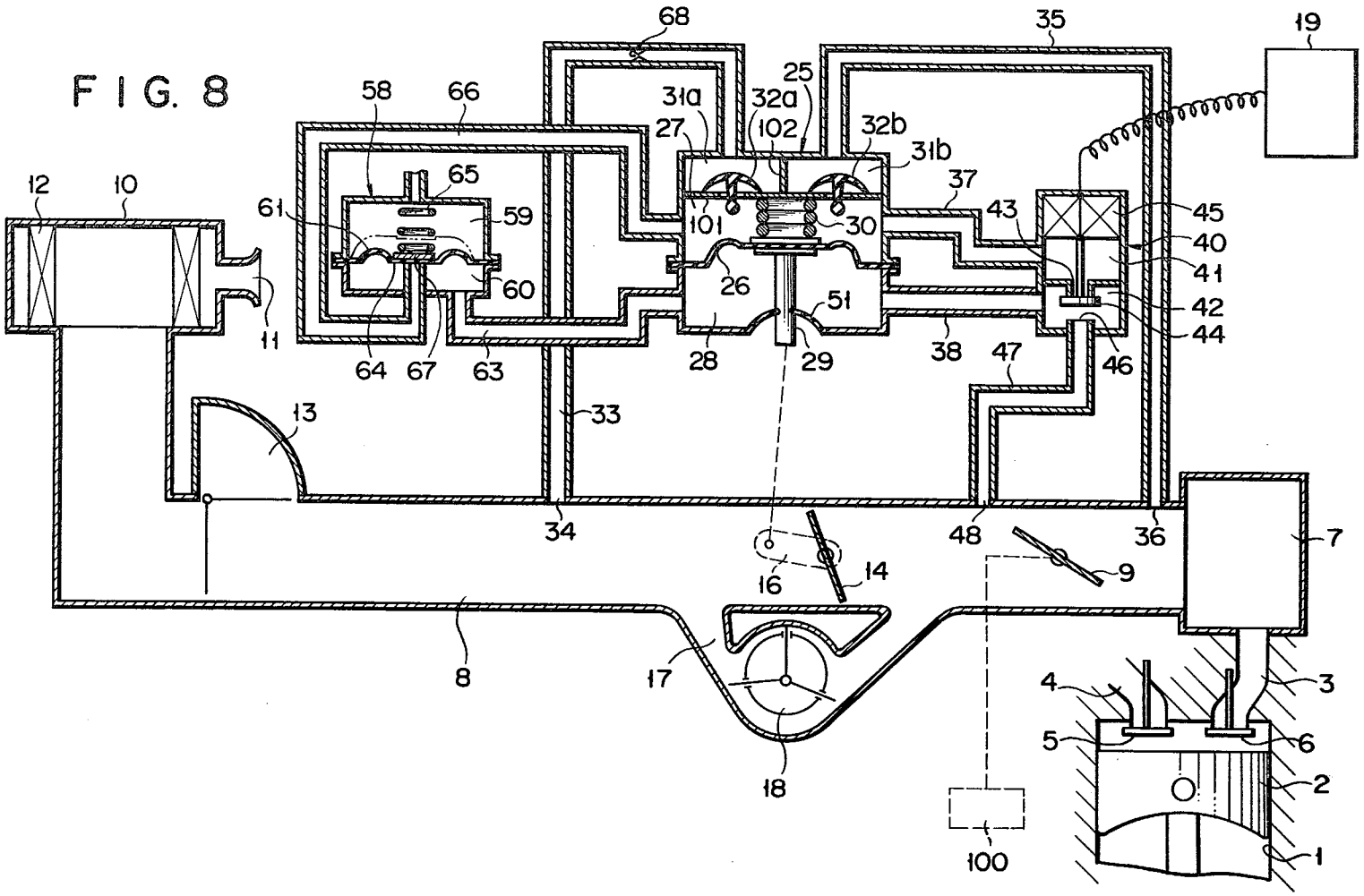

FIGS. 7 and 8 show an apparatus according to a third embodiment of the present invention. A pressure change-over valve 58 coupled to an actuator 25 is added to the arrangement of the first embodiment.

The pressure change-over valve 58 is partitioned by a diaphragm 61 into an upper valve chamber 59 and a lower valve chamber 60. The upper valve chamber 59 is open to the atmosphere through an opening 62 formed in the upper end thereof. The lower valve chamber 60 communicates with a lower pressure chamber 28 of the actuator 25 through a pressure introducing passage 63. A plate valve 64 is usually disposed on the central part of the diaphragm 61 and is constantly urged downward by a compression coil spring 65 housed in the upper valve chamber 59. A pressure introducing pipe 66 extends into the lower pressure chamber 60. One end of the pressure introducing pipe 66 opposes the plate valve 64 and constitutes a valve bore 67 which is opened or closed by the plate valve 64. The other end of the pressure introducing pipe 66 communicates with the upper pressure chamber 27 of the actuator 25.

An orifice 68 is formed in a pressure escaping passage 33 to delay pressure transmission.

Since the pressure in the lower valve chamber 60 is not so high in the non-supercharging state shown in FIG. 7, the plate valve 64 closes the valve bore 67 by the action of the compression coil spring 65.

The supercharging operation of the third embodiment is substantially the same as that of the first embodiment. When the supercharging pressure exceeds a predetermined value and hence the pressure in the lower pressure chamber 28 of the actuator 25 exceeds the preset value, the pressure in the lower pressure chamber 28 is introduced into the lower valve chamber 60 of the pressure change-over valve 58 through the pressure introducing passage 63. The diaphragm 61 flexes upward against the urging force of the compression coil spring 65, as indicated by the imaginary line in FIG. 8. The plate valve 64 is then released from the valve bore 67 to open it. As a result, the lower pressure chamber 28 of the actuator 25 communicates with the upper pressure chamber 27 through the pressure change-over valve 58, so that a pressure difference therebetween is decreased and the diaphragm 26 is urged downward by the compression coil spring 30, whereby the supercharger control valve 14 is pivoted by an actuating rod 29 to open the intake passage 8. The excessive pressurized air in the intake passage 8 is released through the supercharger control valve 14. Therefore, supercharging is performed with a proper pressure.

The pressurized air in the upper pressure chamber 26 is hardly conducted to the intake passage 8 through the pressure check valve 32*a*, the pressure-introducing chamber 31*a* and the pressure escaping passage 33, since the flow of the pressurized air is restricted by the orifice 68. The pressurized air is also prevented from flowing from the upper pressure chamber 26 to the intake passage 8 through the check valve 32*b*, the pressure-introducing chamber 31*b* and the first pressure introducing passage 35, because the pressure in the upper pressure chamber 26 is substantially equal to that at the second pressure-detecting port 48. As a result, the pressure in the upper pressure chamber 27 remains positive, whereby the supercharger control valve 14 is kept opened.

The pressure change-over valve 58 does not directly communicate with the intake passage 8. Therefore, even if trouble occurs in the pressure change-over valve 58 or it is damaged, a broken piece thereof may not be introduced into the intake passage 8 and may not be clogged in the throttle valve 9.

Figure 9:
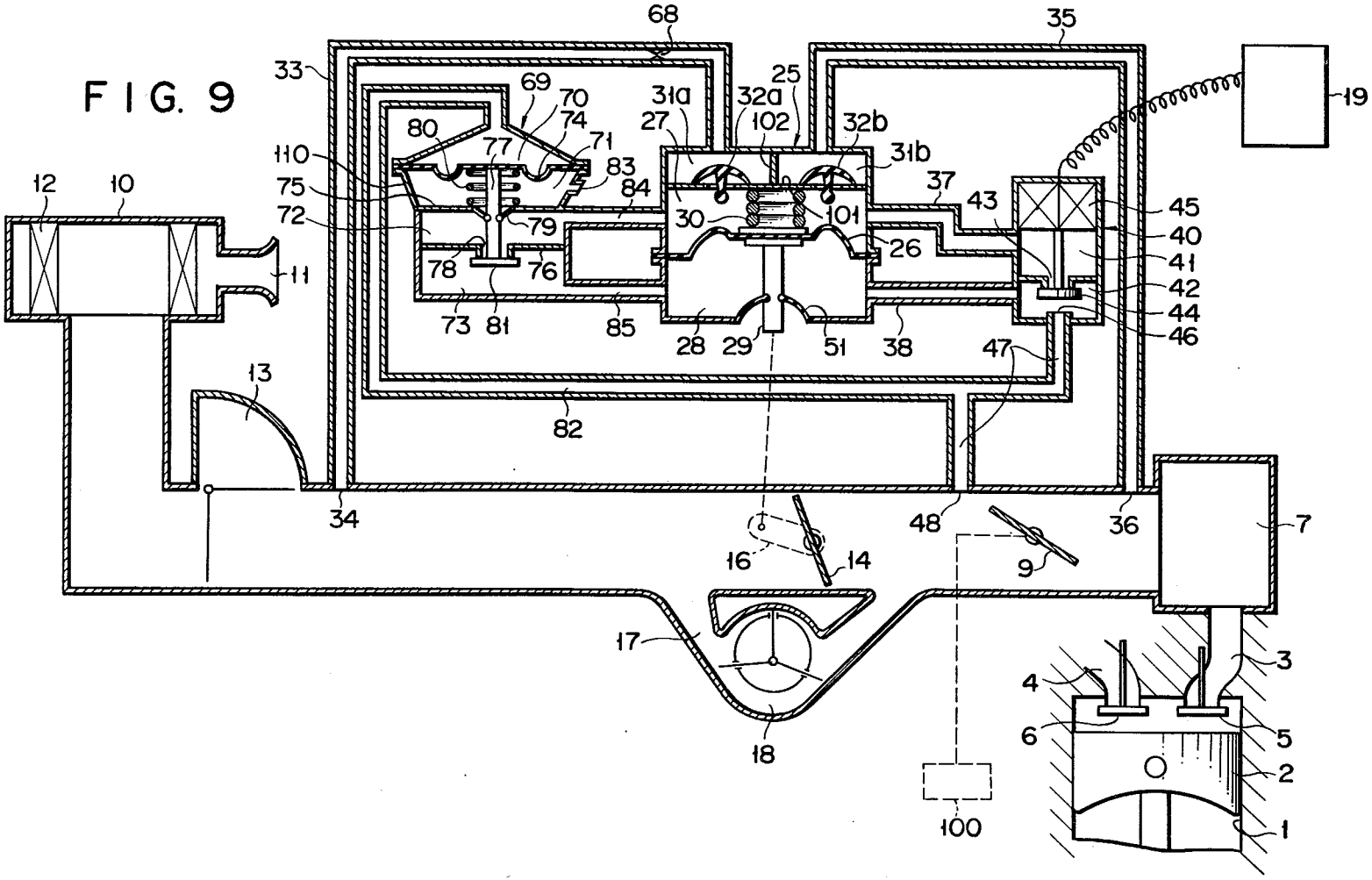
FIG. 9 is a longitudinal sectional view of a modification of the control apparatus shown in FIGS. 7 and 8.

FIG. 9 shows a modification of the apparatus of the third embodiment. A pressure change-over valve 69 has a housing 110. Formed in the housing 110 are first to fourth valve chambers 70 to 74 which are partitioned by a diaphragm 74 and two partition walls 75 and 76. A valve stem 77, the upper end of which is fixed to the central portion of the diaphragm 74 extends through the center of the partition wall 75 and further extends into the fourth valve chamber 73 through a valve bore 78 formed at the center of the partition wall 76. The valve stem 77 is sealingly surrounded by a seal member 79 disposed at the center of the partition wall 75. Further, the valve stem 77 is urged upward by a compression coil spring 80 which surrounds the valve stem 77 and which is disposed between the diaphragm 74 and the partition wall 75 in the second valve chamber 71. A plate valve 81 is fixed to the lower end of the valve stem 77 to normally close the valve bore 78.

The first valve chamber 70 is coupled to an intermediate portion of a fourth pressure-introducing passage 47 through a pressure introducing passage 82. The second valve chamber 71 is open to the atmosphere through an opening 83. The third valve chamber 72 communicates with the upper pressure chamber 27 through a pressure introducing passage 84. The fourth valve chamber 73 communicates with the lower pressure chamber 28 through a pressure introducing passage 85.

In the above modification, when the pressure in the lower pressure chamber 28 exceeds the preset value, it acts on the diaphragm 74 in the first valve chamber 70 through the pressure introducing passage 82. The diaphragm 74 is moved downward against the urging force of the compression coil spring 80. The valve stem 77 is then moved downward to separate the plate valve 81 from the valve bore 78, whereby the third and fourth valve chambers 72 and 73 communicate with each other. Therefore, the upper pressure chamber 27 communicates with the lower pressure chamber 28 through the pressure change-over valve 69. The same pressure compensating effect as the third embodiment is obtained in the modification described above.

Figure 10:
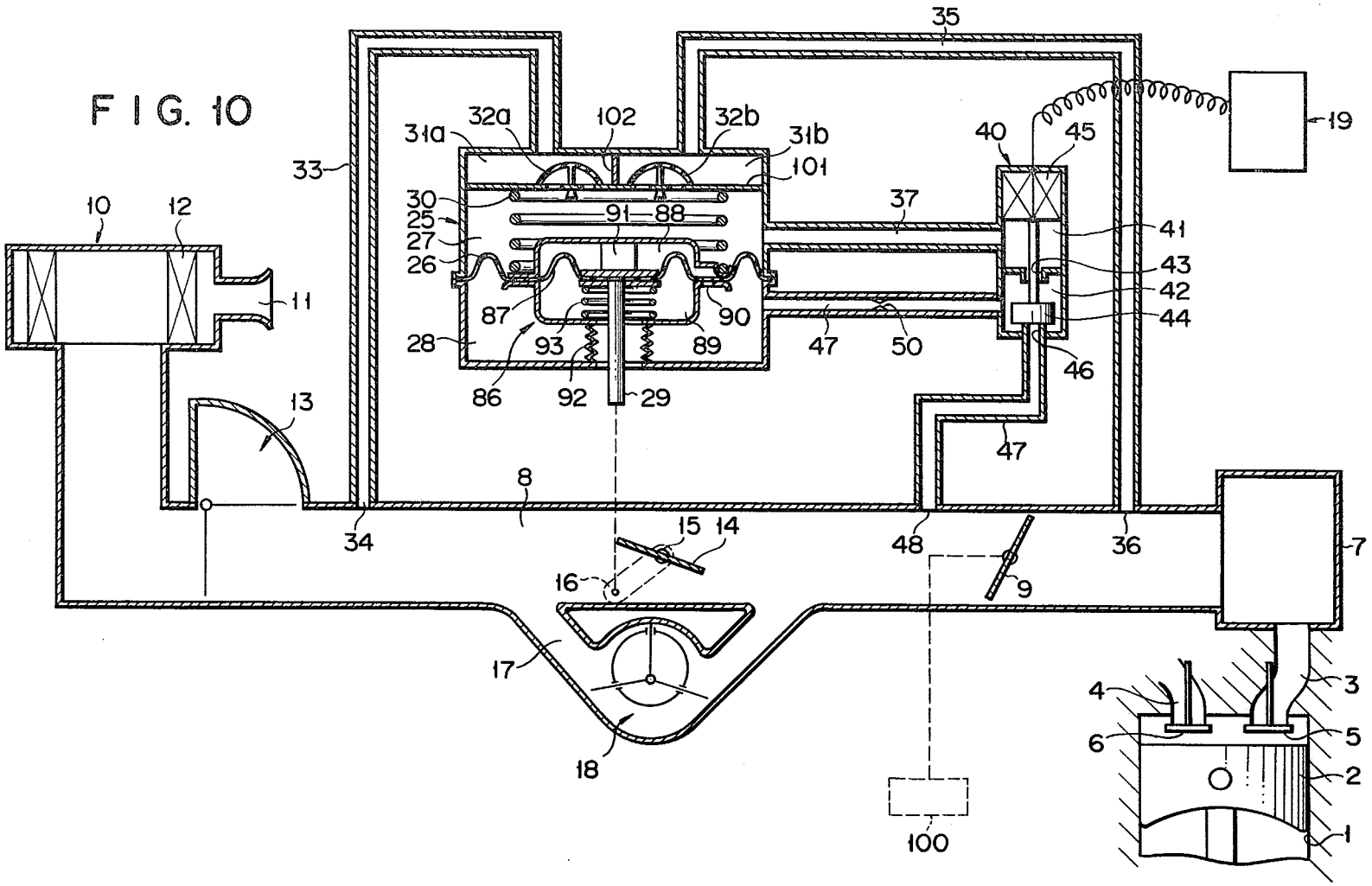
FIG. 10 and 11 are longitudinal sectional views of a control apparatus according to a fourth embodiment of the present invention, showing the non-supercharging and supercharging states, respectively.
Figure 11:
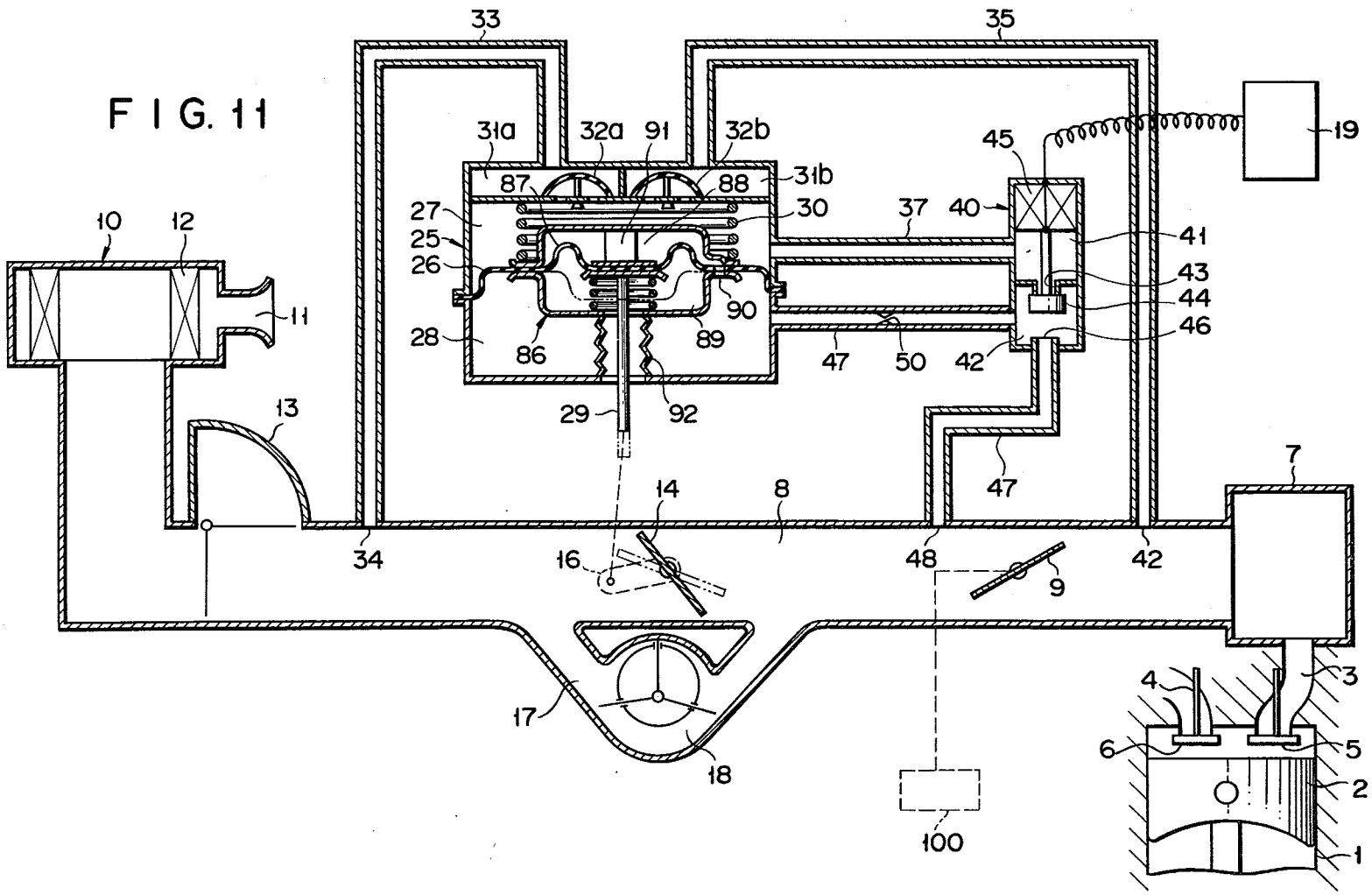

FIGS. 10 and 11 show an apparatus of a fourth embodiment which is the same as that of the first embodiment except for the actuator structure. An actuator 25 is divided into an upper pressure chamber 27 and a lower pressure chamber 28 by a first diaphragm 26. A pressure case 86 is mounted in the central portion of the first diaphragm 26. When the first diaphragm 26 flexes due to a pressure difference between the upper and lower pressure chambers 27 and 28, the pressure case 86 is displaced together with the first diaphragm 26. A compression coil spring 30 is disposed in the upper pressure chamber 27 to normally urge the diaphragm 26 downward.

The pressure case 86 is divided into an upper pressure chamber 88 and a lower pressure chamber 89 by another diaphragm 87. The upper pressure chamber 88 communicates with the lower pressure chamber 28 through a communicating hole 90. A stop 91 is disposed in the upper pressure chamber 88 to regulate vertical movement of the second diaphragm 87. The upper end of an actuating rod 29 is fixed to the second diaphragm 87. The actuating rod 29 extends through the lower walls of the pressure case 86 and the actuator 25 and is connected to a control lever 16 of an supercharger control valve 14. The second diaphragm 87 may be integral with the first diaphragm 26. The lower pressure chamber 89 is open to the atmosphere through a bellows 92 disposed between the lower wall of the pressure case 86 and the lower wall of the actuator 25. The actuating rod 29 extends through the bellows 92. A compression coil spring 93 is housed in the lower pressure chamber 89 to urge the second diaphragm 87 upward.

The upper pressure chamber 27 of the actuator 25 has two pressure introducing chambers 31*a* and 31*b* which are partitioned by partition walls 101 and 102. Other parts of the arrangement are the same as those in the first embodiment.

If the actual operating conditions of the engine do not reach the preset conditions which is memorized in the electronic control device 19, the negative pressure in the upper and lower pressure chambers 27 and 28 remains at the same level in the same manner as the previous embodiments and modifications. As shown in FIG. 10, the first diaphragm 26 is urged downward by the compression coil spring 30 and the pressure case 86 is kept in the lowest position, while the second diaphragm 87 is kept at the highest position and abuts against the stop 91 since the upper pressure chamber 88 communicates with the lower pressure chamber 28 which is exerted by the negative pressure. The actuating rod 29 urges the control lever 16 of the supercharger control valve 14 downward, whereby the supercharger control valve 14 opens the intake passage 8, thus maintaining non-supercharging conditions.

However, when the actual operating conditions of the engine reach the preset conditions, the positive pressure in the lower pressure chamber 28 is gradually incresed to a pressure at the second pressure-detecting port 48, although pressure transmission is delayed by the orifice 50, so that the first diaphragm 26 flexes upward against the compression coil spring 30 as shown in FIG. 11 and the pressure case 86 is moved upward. The actuating rod 29 is then raised to close the supercharger control valve 14. Thus, supercharging is initiated.

In order to compensate for air leakage, the air pump 18 as the supercharger generally has a capacity which is greater than the capacity corresponding to the necessary amount of pressurized air supplied to the engine. Excessive pressurized air may be supplied to the engine during the operation of the supercharger. The excessive pressurized air results in a great positive pressure at that portion of the intake passage 8 between throttle valve 9 and the supercharger control valve 14. The excessive pressurized air is then supplied to the lower pressure chamber 28 of the actuator 25 and to the upper pressure chamber 88 of the pressure case 86 through the communicating hole 90, whereby the second diaphragm 87 flexes downward. The actuating rod 29 is moved downward to open the supercharger control valve 14, thus eliminating the excessive air pressure in the intake passage 8. The pressure chambers 28 and 88 restore the normal pressure, and the second diaphragm 87 returns to the operating position by the urging force of the compression coil spring 93. Therefore, the actuating rod 92 is lowered again to close the supercharger control valve 14, whereby the intake passage 8 is used for supercharging again. In other words, the supercharger control valve 14 is automatically opened and closed in accordance with the pressure conditions of the upstream of the throttle valve 9 so as to maintain the supercharging pressure constant.

In the embodiments and modifications shown in FIGS. 5 to 11, the first pressure-introducing passage 35 communicates with the pressure introducing chamber 31*b*, while it may communicate with the pressure-receiving chamber 43 of the change-over valve 40 as in the modification shown in FIG. 3.

In the embodiments and modification shown in FIGS. 5 to 9, the actuator 25 may be replaced with the piston-cylinder assembly in the manner as in the modification in FIG. 4.

In the above embodiments and modifications, the air pump 18 as the supercharger is operative or inoperative when it is connected to or disconnected from the crankshaft by means of the electromagnetic clutch. With the above arrangements, no power is required for driving the air pump 18 when the engine is driven with a low load at a low speed. Thus, output power may not be lowered. However, the air pump may be always coupled to the crankshaft. Alternatively, a turbo charge system may be utilized wherein the air pump is driven by an exhaust gas of the engine. This is because the pressurized air is not substantially supplied to the engine since the engine is driven at a low speed or the opening of the throttle valve is small. Therefore, even if the supercharger is always operated while the engine is being driven, no trouble occurs.

Figure 12:
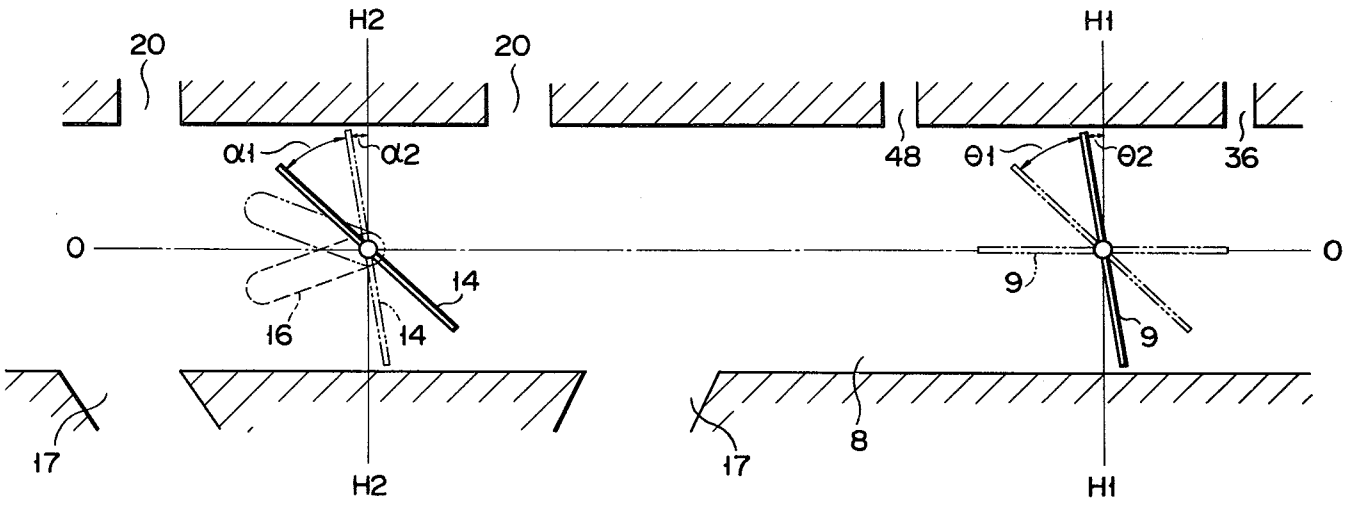
FIG. 12 is a schematic view for explaining supercharging control with reference to the opening of the throttle valve in the first to fourth embodiments and their modifications in FIGS. 1 to 11.

A case will be described with reference to FIG. 12 wherein supercharging is performed in the embodiments and modifications in FIGS. 1 to 11 when the throttle valve 9 is opened at an angle equal to or greater than a predetermined angle.

When the throttle valve 9 is completely closed, it is tilted at an angle $\theta 2$ (e.g., 10°) from a plane H1—H1 perpendicular to an axis O—O. When the throttle valve operator 100 is operated to gradually tilt the throttle valve 9 between an angle $\theta 2+\theta 1$ where $\theta 1$ is the predetermined angle (e.g., 40°) and a maximum angle at which the throttle valve 9 is aligned with the axis O—O, the electronic control device 19 drives the electromagnetic clutch which in turn drives the air pump 18. Simultaneously, the electronic control device 19 supplies the command signal to the solenoid coil 45 which is then excited. As a result, the actuating rod 29 is raised. The supercharger control valve 14 is then tilted at an angle ($\alpha 1+\alpha 2$) (e.g., the angle $\alpha 1$ is 50°) from a plane H2—H2 perpendicular to the axis O—O of the intake passage 8 to the angle $\alpha 2$ (e.g., 10°) with respect to the plane H2—H2. The angle ($\alpha 1+\alpha 2$) corresponds to the maximum opened position, while the angle $\alpha 2$ corresponds to the completely closed position. As a result, the engine is supercharged. Note that the angle $\alpha 1$ is substantially the same as the angle $\theta$.

If the angle of the throttle valve 9 which corresponds to the position where the engine is supercharged is set at the angle $\theta 1$, supercharging is only performed when the engine requires it.

In the above example, since the angle ($\alpha 1+\alpha 2$) corresponding to the maximum opened state of the supercharger control valve 14 is substantially equal to the predetermined angle ($\theta 1+\theta 2$), the pivotal range of the supercharger control valve 14 is narrower. The displacement of the diaphragm 26 becomes then small. As a result, a compact actuator can be manufactured. Further, since the diaphragm slightly flexes, its durability is greatly improved, and its stroke is shortened to improve responsiveness of the supercharger control valve 14, thus achieving smooth and quick pivotal movement of the supercharger control valve 14.

What we claim is:

1. An apparatus for controlling pressurized air supply to an engine, comprising:

an intake passage connected to the engine at a downstream end thereof;

a throttle valve disposed at a downstream side of said intake passage;

a supercharger control valve disposed at an upstream side of said throttle valve in said intake passage;

a supercharging passage connected to said intake passage at both upstream and downstream sides of said supercharger control valve;

a supercharger disposed in said supercharging passage;

an actuator which has an actuating body provided in said actuator for dividing said actuator into first and second pressure chambers and operatively connected to said supercharger control valve to close said supercharger control valve when said actuating body is moved in a first direction to decrease the volume of said first pressure chamber and to open said supercharger control valve when said actuating body is moved in a second direction to increase the volume of said first pressure chamber, and which has urging means for urging said actuating body in said second direction;

a change-over valve which has a first pressure-receiving chamber communicating with said first pressure chamber, a second pressure-receiving chamber communicating with said second pressure chamber and a portion of said intake passage between said throttle valve and said supercharger control valve, and a valve body selectively positioned between a first position where said valve body allows said first pressure-receiving chamber to communicate with said second pressure-receiving chamber and also blocks said second pressure-receiving chamber from said intake passage and a second position where said valve body blocks said first pressure-receiving chamber from said second pressure-receiving chamber and allows said second pressure-receiving chamber to communicate with said intake passage; and a pressure introducing passage having one end connected to the downstream of said throttle valve in said intake passage and the other end communicating with said first pressure chamber.

2. An apparatus according to claim 1, further comprising pressure change-over means connected to said first and second pressure chambers of said actuator, for causing said first and second pressure chambers to communicate with each other when a pressure of said second pressure chamber is equal to or higher than a predetermined pressure.

3. An apparatus according to claim 2, wherein said pressure change-over means comprises:

a diaphragm for partitioning the interior of said pressure change-over means into a first valve chamber open to the atmosphere and a second valve chamber communicating with said first and second pressure chambers, said diagram being formed with a valve bore;

a plate valve disposed on said valve bore in said first valve chamber; and a compression coil spring disposed in said first valve chamber to normally urge said plate valve for closing said valve bore.

4. An apparatus according to claim 2, wherein said pressure change-over means comprises:

a housing;

a diaphragm, a first partition wall and a second partition wall with a valve bore arranged parallel in succession in said housing;

a first valve chamber defined by said housing and said diaphragm and communicating with said second pressure-receiving chamber and said portion of said intake passage between said supercharger control valve and said throttle valve;

a second valve chamber defined by said housing, said diaphragm and said first partition wall and communicating with the atmosphere;

a third valve chamber defined by said housing and said first and second partition walls and communicating with said first pressure chamber;

a fourth valve chamber defined by said housing and said second partition wall and communicating with said first pressure chamber;

a valve stem extending through said first partition wall and said valve bore of said second partition wall, said valve stem having one end connected to said diaphragm and the other end connected to a plate valve; and a compression coil spring disposed between said diaphragm and said first partition wall for causing said plate valve to close said valve bore.

5. An apparatus according to claim 2, wherein said actuator has first and second pressure-introducing chambers disposed adjacent to said first pressure chamber, and check valves each disposed between said first pressure-introducing chamber and said first pressure chamber and between said second pressure-introducing chamber and said first pressure chamber for allowing pressurized air to flow only from said first pressure chamber to said first and second pressure-introducing chambers, and there is further provided a pressure escaping passage having one end connected to said first pressure-introducing chamber and the other end connected to an upstream side of said intake passage, said second pressure-introducing chamber communicating with said pressure introducing passage.

6. An apparatus according to claim 5, wherein said pressure escaping passage has an orifice therein.

7. An apparatus according to claim 1, further comprising an accumulator connected to said second pressure-receiving chamber of said change-over valve and said portion of said intake passage between said supercharger control valve and said throttle valve, said accumulator having a check valve for allowing pressurized air to flow only from said intake passage to said second pressure-receiving chamber through said change-over valve.

8. An apparatus according to claim 1, wherein said actuating body comprises a diaphragm.

9. An apparatus according to claim 8, wherein said diaphragm has a pressure case provided in the central portion thereof, said pressure case comprising a third pressure chamber communicating with said second pressure chamber, a fourth pressure chamber open to the atmosphere, another diaphragm for partitioning said third and fourth pressure chambers and urging means for urging said another diaphragm in said second direction, said another diaphragm being operatively connected to said supercharger control valve to open said supercharger control valve when said another diaphragm is moved in said second direction.

10. An apparatus according to claim 9, wherein a stop is disposed in said third pressure chamber to regulate the degree of deflection of said aother diaphragm toward said third pressure chamber.

11. An apparatus according to claim 9, wherein each of said urging means comprises a compression coil spring.

12. An apparatus according to claim 1, wherein said actuating means comprises a piston.

13. An apparatus according to claim 1, wherein said pressure introducing passage communicates with said first pressure chamber through said first pressure-receiving chamber of said change-over valve.

14. An apparatus according to claim 1, wherein said second pressure chamber and said second pressure-receiving chamber are connected by means of another pressure introducing passage which is provided with an orifice.

15. An apparatus according to claim 1, further comprising an electronic control device for controlling said change-over valve.

16. An apparatus according to claim 15, wherein said change-over valve comprises a solenoid valve.

17. An apparatus according to claim 1, wherein said change-over valve is actuated when said throttle valve is tilted at an angle equal to or greater than a predetermined angle.

18. An apparatus according to claim 17, wherein said supercharger control valve is tilted at an angle substantially the same as the predetermined angle of said throttle valve.

* * * * *